US006260494B1

(12) United States Patent
Inoue et al.

(10) Patent No.: US 6,260,494 B1
(45) Date of Patent: Jul. 17, 2001

(54) SEWING MACHINE WITH DUST REMOVING DEVICE

(75) Inventors: Tadanori Inoue, Toyonaka; Yoshihide Shimizu, Yoyonaka, both of (JP)

(73) Assignee: Yamato Sewing Machine Seizo Co., Ltd. (JP)

( * ) Notice: Subject to any disclaimer, the term of this patent is extended or adjusted under 35 U.S.C. 154(b) by 0 days.

(21) Appl. No.: 09/565,361

(22) Filed: May 5, 2000

(30) Foreign Application Priority Data

Jun. 17, 1999 (JP) ..... 11-208080

(51) Int. Cl.[7] ..... D05B 71/00
(52) U.S. Cl. ..... 112/280; 112/282
(58) Field of Search ..... 112/280, 282, 112/256; 165/122, 47; 184/6.5; 15/301; 454/189

(56) References Cited

U.S. PATENT DOCUMENTS 2,447,115 * 8/1948 Christensen ..... 112/282
3,779,188 * 12/1973 Marforio ..... 112/280
4,145,985 * 3/1979 Klundt ..... 112/280
5,207,167 * 5/1993 Inomata ..... 112/280
5,669,319 * 9/1997 Liang ..... 112/282

* cited by examiner

*Primary Examiner*—Ismael Izaguirre
(74) *Attorney, Agent, or Firm*—D. Peter Hochberg; Katherine R. Vieyra; William H. Holt

(57) ABSTRACT

A sewing machine with a dust removing device prevents trouble such as faulty sewing caused when dust including waste thread and waste cloth is collected under a throat plate, in performing, for example, interlock stitch sewing by an overlock sewing machine. Specifically, an upward air introducing path is provided, through which the cooling airflow generated by a cooling fan actuated during sewing operation is fed to an air introducing path for oil cooling underneath a lubricating oil storage part, and, through which the cooling airflow passing through the air introducing path for oil cooling is blown up from the underside of a frame to a needle location of the throat plate, in order to blow up the dust. An opening of one end of a suction pipe for collecting dust attached to the frame is disposed sidewise above the throat plate. The self-cleaning action obtained by effectively utilizing the airflow from the cooling fan for cooling lubricating oil, enables to prevent trouble such as faulty sewing due to the collected dust, and prevent dust from widely scattering around the upside of the throat plate, thereby to maintain working environment hygienic.

4 Claims, 4 Drawing Sheets

SEWING MACHINE WITH DUST REMOVING DEVICE

BACKGROUND OF THE INVENTION

1. Field of the Invention

The present invention relates to a sewing machine with a dust removing device. More particularly, the invention relates to a sewing machine with a dust removing device which is so constructed as to prevent trouble such as faulty sewing to be caused when dust including waste thread and waste cloth is collected under a throat plate, in performing, for example, interlock stitch sewing by an overlock sewing machine.

2. Description of the Prior Art

In the event that dust including waste thread and waste cloth to be produced-during sewing operation by a sewing machine, is collected at the underside of a throat plate at which sewing parts such as a looper, fabric feed mechanism and knife driving mechanism are disposed, there is a tendency that a needle thread loop is not formed in a predetermined manner, resulting in a faulty sewing such as skip-stitch. If dust is more collected there, the dust will interfere with movable parts such as a needle and looper, and thus cause the deformation and damage on the movable parts.

In order to prevent the faulty sewing and deformation of the movable parts because of the collected dust as described, the following conventional manner has generally been taken. That is, an air gun is manually operated to spray airflow around the underside of the throat plate, thereby to scatter and remove the collected dust. With this manner, however, it is sometimes required to spray airflow by interrupting the operation of the sewing machine in the course of sewing. That is, not only such a time-consuming and tedious cleaning operation but also a lot of time for this cleaning is required, resulting in a low sewing efficiency. In addition, when airflow is sprayed, the collected dust may scatter and suspend around the sewing machine, thus deteriorating working environment.

To solve these problems, U.S. Pat. No. 5,454,338 discloses a sewing machine equipped with a dust removing device (hereinafter referred to as prior art. This prior art is provided with a fan by which an external air is forced to pass through the radiator of an oil cooler for cooling lubricating oil used for lubricating the interior of the sewing machine. By introducing the airflow caused by the fan and then passed through the radiator, into the inside of the sewing machine, the interior of the sewing machine is retained at positive pressure so as to prevent dust including Waste thread, etc. from entering the sewing machine.

In this prior art so constructed, the function of preventing dust entering the sewing machine can be attained by utilizing the airflow generated by the fan for the oil cooler that is originally equipped with the sewing machine in order to cool lubricating oil. Therefore, as compared to the above-mentioned manual removing means of spraying airflow by the air gun, there is no need to perform such cleaning that is tedious and lowers sewing efficiency. That is, such a self-cleaning operation enables to prevent trouble such as faulty sewing due to the dust collected beneath the throat plate.

However, this prior art is constructed so as to merely prevent dust entering the sewing machine by introducing the above-mentioned airflow to retain its inside at positive pressure. It is therefore impossible to prevent trouble caused by the dust collected beneath the throat plate. Further, the interior of the sewing machine is not a completely closed room, and it is thus unavoidable to make working environment not hygienic. This is because, for example, the introduced airflow is blown out to the exterior from the clearance in a needle location of the throat plate, and dust is scattered and suspended around the throat plate. Furthermore, one which is introduced into the sewing machine is airflow heated by heat exchange with the radiator, and it is suppressed that the heated airflow is blown out to the exterior. Therefore, the temperature in the sewing machine will be gradually increased, thereby to facilitate a temperature rise in the movable parts such as the needle and looper which are likely to be heated by the friction during sewing operation. As a result, the thread in contact with the needle and looper is unexpectively cut by heat.

SUMMARY OF THE INVENTION

It is therefore an object of the present invention to provide a sewing machine with a dust removing device which can prevent trouble such as faulty sewing due to the collected dust, and which can also prevent dust from widely scattering and suspending around the upside of a throat plate, to maintain hygienic working environment, by self-cleaning action obtained by effectively utilizing the airflow from a cooling fan disposed originally for cooling lubricating oil.

According to the present invention, a sewing machine having a frame, throat plate, needle location formed on the upper surface of the throat plate, and sewing parts beneath the throat plate, which are all disposed beneath the side of the frame, and having a lubricating oil storage part beneath the frame, is characterized in having a dust removing device which comprises: a cooling fan for feeding a cooling airflow toward an air introducing path for oil cooling formed beneath the lubricated oil storage part, the cooling fan being disposed opposite to the side on which the needle location of the frame is present; an upward air introducing path through which dust is blown up by blowing off a cooling airflow after being fed from the cooling fan and passing through the air introducing path for oil cooling dust, from the underside of the frame to the needle location; and an opening of one end of a suction pipe for collecting dust that is attached to the frame and contains in its interior a forced suction airflow, the opening being disposed sidewise above the throat plate.

With this construction, the cooling airflow generated by the cooling fan that is actuated during sewing operation, is fed to the air introducing path for oil cooling underneath the lubricating oil storage part, so as to cool the lubricating oil stored therein. Thereafter, this cooling airflow is introduced to the upward air introducing path, and blown off from the underside of the frame to the needle location, such that the dust including such as waste thread collected beneath the throat plate, is blown up above the throat plate.

By virtue of such a self-cleaning action, it is able to prevent a faulty sewing due to the dust collected beneath the throat plate, and trouble such as the deformation and damage on the movable parts, such as a needle and looper, due to the interference between the movable parts and the collected dust.

Further, thanks to the dust discharging action by which the airflow containing dust blown up above the throat plate is sucked into the suction pipe for collecting dust, and then fed through the suction pipe to a predetermined place for discharge, it is avoided that the dust blown up from the underside of the throat plate will scatter widely around the upside of the throat plate, thus maintaining working environment clean and hygienic.

Furthermore, the cooling airflow of which temperature is increased by heat exchange with the lubricating oil is not allowed to remain underneath the throat plate but is forced to flow by a forced suction airflow. Thereby, heat does not stay underneath the throat plate. It is therefore able to prevent such trouble that the thread in contact with the needle and looper is unexpectively cut by heat, because of the temperature rise in the movable parts.

Preferably, the air introducing path for oil cooling is provided with a damper for adjusting the amount of blow-off of the cooling airflow fed to the air introducing path, toward the upward air introducing path.

With this construction, according to the kind of the fabric and the kind of the sewing, the blow-off amount of airflow can be arbitrarily adjusted to suppress the blow-up of dust and the occurrence of noise, thus permitting further improvement in working environment.

These and other objects, features, aspects and advantages of the present invention will become more apparent from the following detailed description of the present invention when taken in conjunction with the accompanying drawings.

DESCRIPTION OF THE PREFERRED EMBODIMENT

One preferred embodiment of the present invention will be described by referring to the accompanying drawings.

Figure 1:
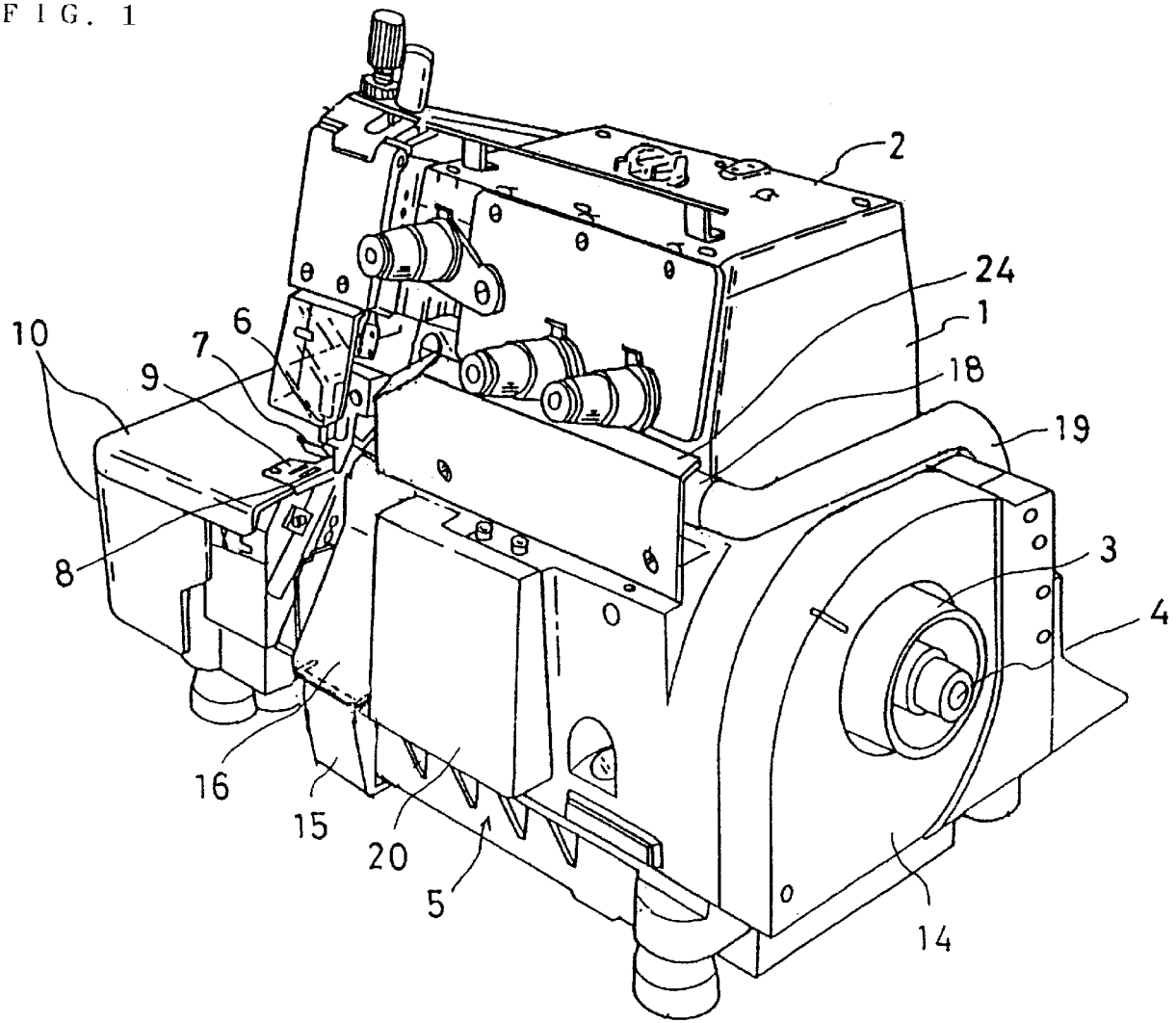
FIG. 1 is a perspective view of an overlock sewing machine with a dust removing device according to the present invention.
Figure 2:
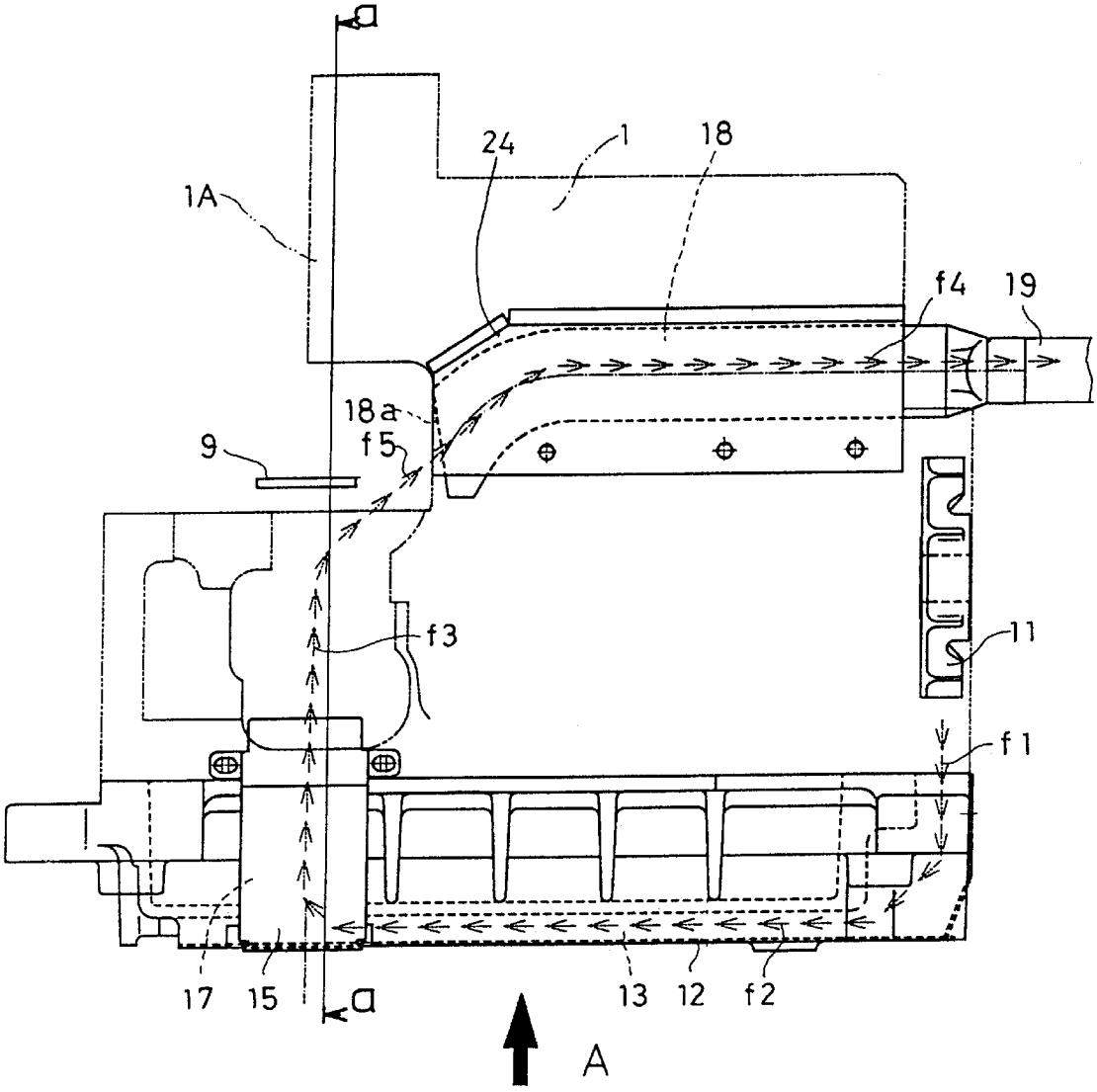
FIG. 2 is a front view illustrating mainly the flow of airflow, with part of the above sewing machine omitted.
Figure 3:
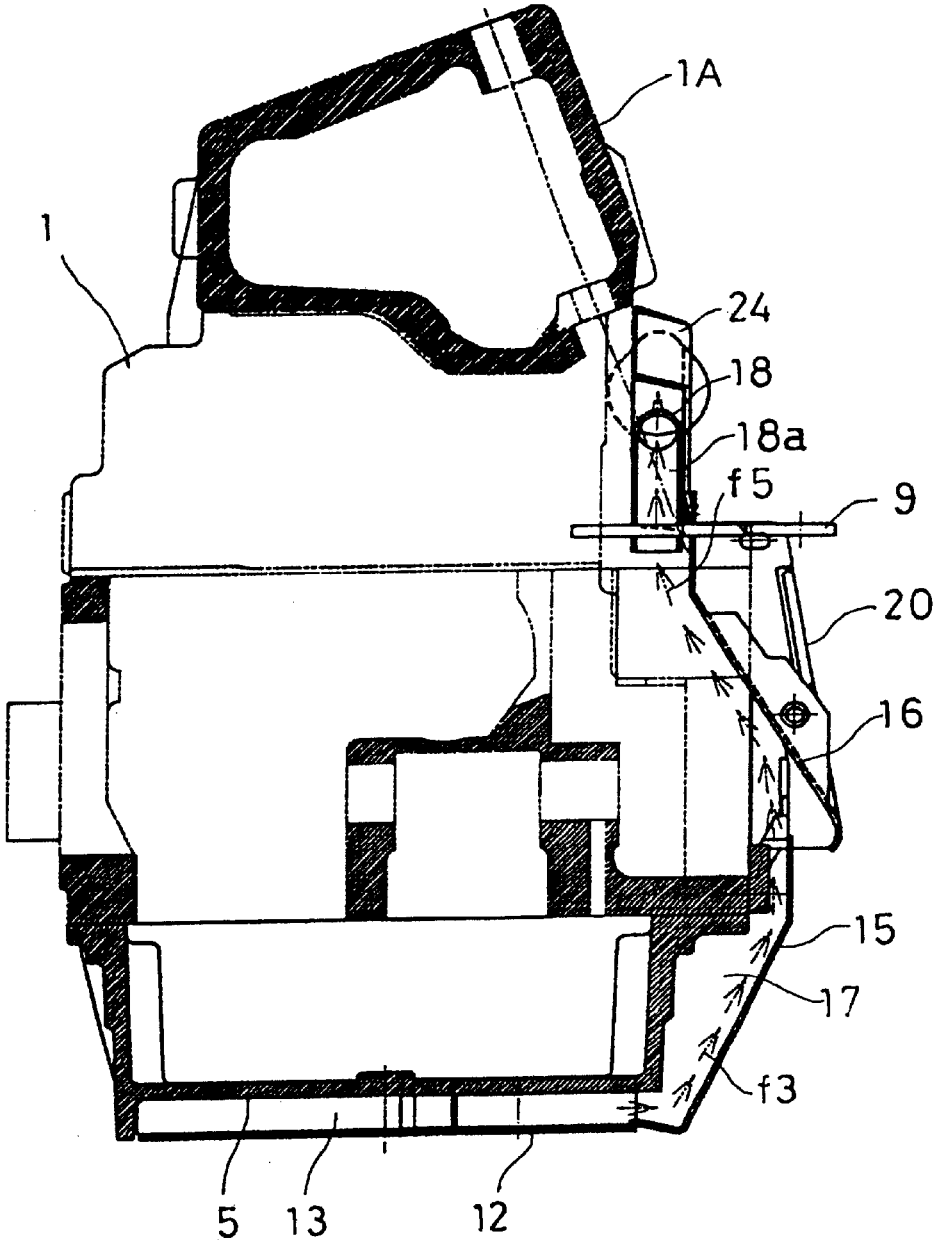
FIG. 3 is a sectional view taken along the line a—a of FIG. 2.
Figure 4:
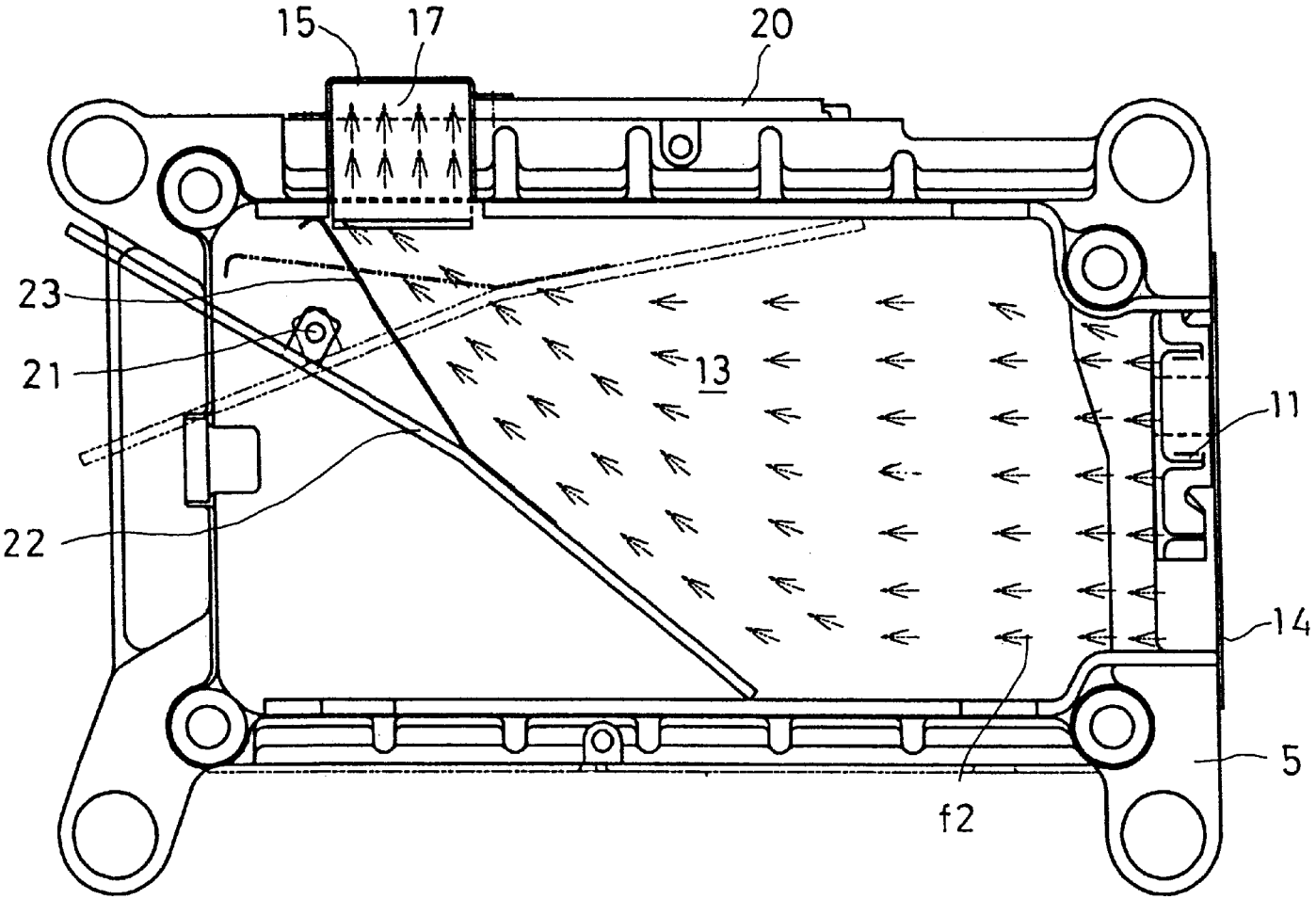
FIG. 4 is a side elevation view in the direction of arrow A of FIG. 2.

FIG. 1 is a perspective view of an overlock sewing machine with a dust removing device according to the present invention. FIG. 2 is a front view illustrating mainly the flow of airflow, with part of the above sewing machine omitted. FIG. 3 is a sectional view taken along the line a—a of FIG. 2. FIG. 4 is a side elevation view in the direction of arrow A of FIG. 2. Referring to FIGS. 1 to 4, an upper cover 2 is attached to the upper end of a frame 1, and a main shaft 4 is rotatably supported at a position nearer to the lower part of the frame 1. A pulley 3 is secured to the end of the main shaft 4 which extends outwardly. An oil reservoir 5 as a lubricating oil storage part is secured to the lower end of the frame 1.

A tip 1A of the frame 1 supports a needle 6 that is reciprocally movable up and down, and a pressure foot 7. To the lower part of the left side of the frame 1, a clothplate 10 is secured which has on its upper surface a throat plate 9 forming a needle location 8. Disposed under the throat plate 9 are sewing parts such as a looper, fabric feed mechanism and knife driving mechanism (Since these are known, its description and drawing are omitted).

A cooling fan 11 that is integrally rotatable with the pulley 3 is secured to the main shaft 4. A longitudinal airflow guide plate 14 is secured to the outer surface on the right end of the frame 1. By the guide plate 14, the cooling airflow generated by the rotation of the cooling fan 11 is fed downwardly (as shown by arrow f1 in FIG. 2) to the right end portion of an air introducing path for oil cooling 13 which is formed between s horizontal airflow guide plate 12 fixed at proper intervals to the bottom surface of the oil reservoir 5, and the bottom surface of the oil reservoir 5. The cooling air, which is fed through the longitudinal airflow guide plate 14 to the right end portion of the air introducing path for oil cooling 13, flows from the right to left side in the air introducing path for oil cooling 13, as indicated by arrow f2 in FIGS. 2 and 4, and the cooling air is then subjected to an indirect heat exchange with the lubricating oil stored in the oil reservoir 5, thereby to cool the lubricating oil.

An airflow introducing guide plate 15 of an approximately U-section is secured to the front face near the left end of the oil reservoir 5. The lower end of the guide plate 15 is fixedly connected to the horizontal airflow guide plate 12, and its upper end extends to the vicinity of the lower end of a chip guard 16 which extends from the immediately underside of the throat plate 9 to an obliquely forward and downward. An upward air introducing path 17 is formed between the airflow introducing guide plate 15 and the front face of the oil reservoir 5, and inside of the chip guard 16. As indicated by arrow f3 in FIGS. 2 and 3, the cooling airflow passing through the air introducing path for oil cooking 13 is blown out from the underside of the frame 1 to the needle location 8 of the throat plate 9, thereby blowing up the dust collected underneath the throat plate 9.

Referring to FIG. 4, a damper 22 that is rockably operable around a spindle 21, is provided in the air introducing path for oil cooling 13. All the cooling airflow for cooling lubricating oil which is fed to the air introducing path for oil cooling 13 by the damper 22 and a plate spring shielding plate 23 secured at its one end to the damper 22, is introduced into the upward air introducing path 17 by rocking the damper 22 into position as indicated by solid line in FIG. 4. Alternatively, by rocking the damper 22 into position as indicated by virtual line in FIG. 4, all the cooling airflow after cooling the lubricating oil is discharged outside toward the left of the frame 1. Thus, the amount of cooling airflow to be introduced into the upward air introducing path 17 is adjustable by the rocking motion of the damper 22.

On the part of the frame 1 which is located slightly above from the throat plate 9, a suction pipe for collecting dust 18 that is laterally long is fixedly supported in its approximately horizontal position, which is clearly illustrated in FIG. 2. The right end of the suction pipe 18 is connected through a suction hose 19 to a common dust collecting duct (not shown), which is, for example, piped throughout almost all region of a sewing work room where sewing machines are placed. Thereby, a forced suction airflow, as indicated by arrow f4 in FIG. 2, is generated in the suction pipe 18. At the left end of the suction pipe 18, there is disposed an opening 18*a* which is formed into an elliptical shape as shown in FIG. 3. By arranging so that the opening 18*a* is disposed sidewise above the throat plate 9, the airflow containing dust after passing through the upward air introducing path 17 and then being blown up above the throat plate 9, is forced to suck from the opening 18*a* into the suction pipe 18.

The suction pipe for collecting dust 18 is secured to the inner surface of a suction pipe cover 24 that is removably attached to the frame 1. The chip guard 16 is integrated with a front opening cover 20 disposed on the front face of the frame 1. With this construction, the opening of the cover 20 makes it easy to perform the maintenance including replacement and check of the sewing parts such as a looper, fabric feed mechanism and knife driving mechanism.

In the overlock sewing machine with a dust removing device thus constructed, as the main shaft 4 is rotated, the needle 6 moves reciprocally up and down, and the sewing parts such as the looper, fabric feed mechanism and knife driving mechanism are operated in synchronization with this movement, thereby performing a predetermined sewing. During this sewing, a cooling airflow is generated by the cooling fan 11 that rotates integrally with the pulley 3, as the main shaft 4 is rotated. The cooling airflow is then fed into the right end portion of the air introducing path for oil cooling 13, through the longitudinal airflow guide plate 14. Thereafter, as indicated by arrow f2 in FIGS. 2 and 4, the cooling airflow flows from the right to the left side in the air introducing path for oil cooling 13, and cools the lubricating oil in the oil reservoir 5 by means of indirect heat exchange.

The cooling airflow after passing through the air introducing path for oil cooling 13 to cool the lubricating oil is then introduced into the upward air introducing path 17 and is blown off from the underside of the fame 1 to the needle location 8 of the throat plate 9, as indicated by arrow f3 in FIGS. 2 and 3. With the cooling airflow thus blown off, dust including such as waste thread collected beneath the throat plate 9, is blown up above the throat plate 9. By virtue of such a self-cleaning action utilizing the airflow for cooling lubricating oil, it is able to prevent a faulty sewing due to the dust collected beneath the throat plate 9, and trouble such as the deformation and damage on the movable parts, such as the needle 6 and looper, due to the interference between the movable parts and the collected dust.

Subsequently, as indicated by arrow f5 in FIG. 2, the airflow containing dust that has been blown up above the throat plate 9 by the self-cleaning action, is sucked into the suction pipe 18, via the opening 18*a* of the suction pipe for collecting dust 18 in which a forced suction airflow is generated, and is then fed through the suction hose 19 to the common dust collecting duct for collective discharge. It is thus avoided that the dust blown up from the underside of the throat plate 9 is widely scattered around the upside of the throat plate 9. This enables to maintain working environment clean and hygienic.

In addition, in sewing operation including the above-mentioned dust removing and collecting operations, the rocking motion of the damper 21 depending on the kind of the fabric and the kind of the sewing, enables to arbitrarily adjust the amount of cooling airflow that is fed from the upward air introducing path 17 to the underside of the throat plate 9. Thereby, the unnecessary blow-up of dust and the occurrence of noise are suppressed so that working environment can be further improved.

The foregoing embodiment is directed to the type in which the right end of the suction pipe for collecting dust 18 is connected to the common duct for collecting dust. This may be replaced with the type of circulating airflow in which the right end of the suction pipe 18 is connected via a bag filter for collecting dust to a suction opening of the cooling fan 11.

While the invention has been shown and described in detail, the foregoing description is in all aspects illustrative and not restrictive. It is therefore understood that numerous modifications and variations can be devised without departing from the scope of the invention.

What is claimed is:

1. In a sewing machine having a frame, throat plate, needle location formed on the upper surface of said throat plate, and sewing parts beneath said throat plate, which are all disposed beneath the side of said frame, and having a lubricating oil storage part beneath said frame, the improvement which comprises a dust removing device having:

a cooling fan for feeding a cooling airflow toward an air introducing path for oil cooling formed beneath said lubricated oil storage part, said cooling fan being disposed opposite to the side on which said needle location of said frame is present;

an upward air introducing path through which dust is blown up by blowing off a cooling airflow after being fed from said cooling fan and passing through said air introducing path for oil cooling dust, from the underside of said frame to said needle location; and an opening of one end of a suction pipe for collecting dust that is attached to said frame and contains in its interior a forced suction airflow, said opening being disposed sidewise above said throat plate.

2. The sewing machine with a dust removing device according to claim 1 wherein said air introducing path for oil cooling is provided with a damper for adjusting the blow-off amount of the cooling airflow fed to said air introducing path, toward said upward air introducing path.

3. The sewing machine with a dust removing device according to claim 1 wherein the other end of said suction pipe for collecting dust is connected to a common dust collecting duct piped in a sewing work room where sewing machines are placed.

4. The sewing machine with a dust removing device according to claim 1 wherein the other end of said suction pipe for collecting dust is connected through a bag filter for collecting dust to a suction opening of said cooling fan, thereby to circulate a cooling airflow produced by said cooling fan.

* * * * *